US008935914B2

(12) United States Patent
Okami et al.

(10) Patent No.: US 8,935,914 B2
(45) Date of Patent: Jan. 20, 2015

(54) EXHAUST DEVICE

(75) Inventors: Hirohisa Okami, Okazaki (JP); Masatoshi Kato, Okazaki (JP)

(73) Assignee: Futaba Industrial Co., Ltd. (JP)

( * ) Notice: Subject to any disclaimer, the term of this patent is extended or adjusted under 35 U.S.C. 154(b) by 134 days.

(21) Appl. No.: 13/579,802

(22) PCT Filed: Feb. 17, 2011

(86) PCT No.: PCT/JP2011/053384

§ 371 (c)(1), (2), (4) Date: Aug. 17, 2012

(87) PCT Pub. No.: WO2011/102419

PCT Pub. Date: Aug. 25, 2011

(65) Prior Publication Data

US 2012/0317961 A1 Dec. 20, 2012

(30) Foreign Application Priority Data

Feb. 17, 2010 (JP) ..... 2010-032609

(51) Int. Cl.

| | |
|---|---|
| ***F01N 13/08*** | (2010.01) |
| ***F02D 41/14*** | (2006.01) |
| ***F01N 13/00*** | (2010.01) |
| ***F01N 3/28*** | (2006.01) |
| *F01N 13/10* | (2010.01) |

(52) U.S. Cl.

CPC ..... *F02D 41/1439* (2013.01); *F01N 13/008* (2013.01); *F01N 3/28* (2013.01); *F01N 2470/08* (2013.01); *F01N 2560/025* (2013.01); *F01N 13/10* (2013.01)

USPC ..... 60/276

(58) Field of Classification Search

CPC ..... F01N 13/008; F01N 2560/025; F01N 2470/08; F01N 2470/24; F01N 13/2892; F02D 41/1439; F02B 77/086

USPC ..... 60/276, 323

See application file for complete search history.

(56) References Cited

U.S. PATENT DOCUMENTS

2006/0000204 A1 1/2006 Tamura et al.

FOREIGN PATENT DOCUMENTS

| | | |
|---|---|---|
| JP | 61062221 | 4/1986 |
| JP | 63100626 | 6/1988 |
| JP | H0272317 | 6/1990 |
| JP | 6101516 | 4/1994 |
| JP | 2003083061 | 3/2003 |
| JP | 2006017081 | 1/2006 |

OTHER PUBLICATIONS

International Search Report dated Apr. 26, 2011 issued in PCT Patent Application No. PCT/JP2011/053384, 2 pages.

International Preliminary Report on Patentability dated Sep. 27, 2012 issued in PCT Patent Application No. PCT/JP2011/053384, 5 pages.

Chinese Office Action dated Jul. 31, 2014 issued in corresponding Chinese Patent Application No. 201180009480.2, 11 pages (English language translation included).

*Primary Examiner* — Kenneth Bomberg

*Assistant Examiner* — Jonathan Matthias

(74) *Attorney, Agent, or Firm* — Grossman Tucker Perreault & Pfleger PLLC

(57) ABSTRACT

An exhaust device includes: an exhaust manifold, an upstream-side cone of a catalyst, an exhaust gas sensor, an outer shell, and a sensor chamber. Between the upstream-side cone and the outer shell, an inflow channel is formed. The inflow channel has an opening that opens inside the exhaust manifold so as to communicate with the sensor chamber.

16 Claims, 5 Drawing Sheets

FIG.5A FIRST CYLINDER
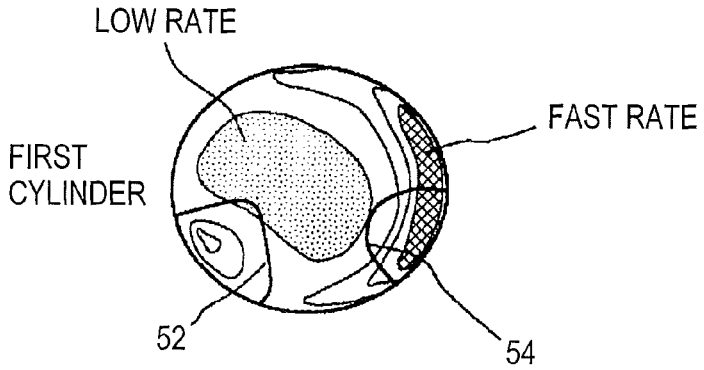
FIG.5B SECOND CYLINDER
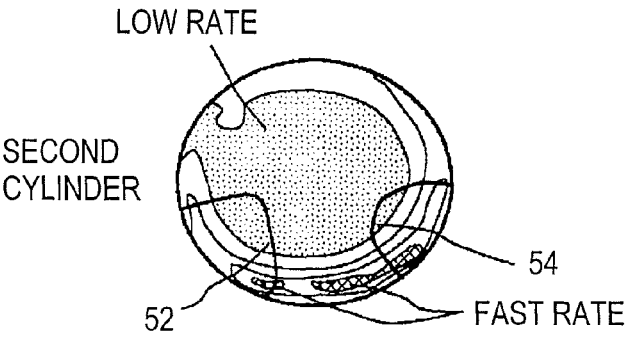
FIG.5C THIRD CYLINDER
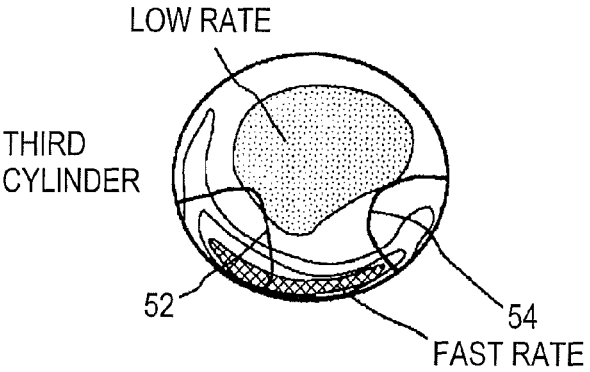
FIG.5D FOURTH CYLINDER
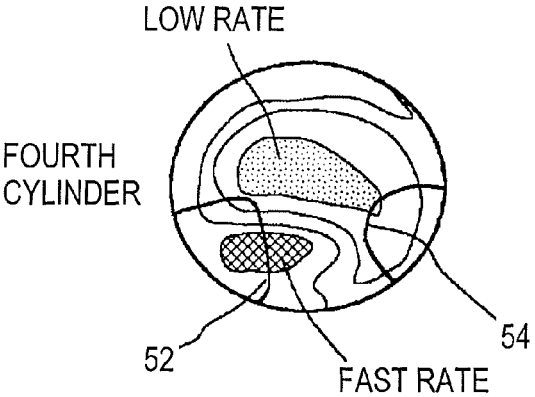

EXHAUST DEVICE

CROSS-REFERENCE TO RELATED APPLICATIONS

This international application claims the benefit of Japanese Patent Application No. 2010-32609 filed Feb. 17, 2010 in the Japan Patent Office, and the entire disclosure of Japanese Patent Application No. 2010-32609 is incorporated herein by reference.

TECHNICAL FIELD

The present invention relates to an exhaust device provided with an exhaust gas sensor that determines an air-fuel ratio of exhaust gases from each exhaust port of a multicylinder internal combustion engine.

BACKGROUND ART

A conventional internal combustion engine includes a catalyst for purifying exhaust gases. In order to fulfill a function of the catalyst, an air-fuel ratio of exhaust gases is determined, and a volume of fuel to be injected to the internal combustion engine is controlled so that the air-fuel ratio becomes a predetermined air-fuel ratio. The air-fuel ratio is detected by an exhaust gas sensor provided at an upstream side of the catalyst.

When exhaust gases from multiple cylinders of the internal combustion engine are collected in an exhaust pipe and one exhaust gas sensor is provided in the exhaust gas pipe in which the exhaust gases are collected, the exhaust gases from each of the cylinders are not dispersed evenly within the exhaust gas pipe. Moreover, among the exhaust gases to be in contact with the exhaust gas sensor, exhaust gases from a specific cylinder have a fast flow rate, while exhaust gases from other cylinders have a slow flow rate. For this reason, a value detected by the exhaust gas sensor is different depending on each of the cylinders.

When the exhaust gas sensor is provided in each exhaust gas port in the multicylinder internal combustion engine with the multiple cylinders, many exhaust gas sensors are necessary. To solve this matter, the following method is known: as disclosed in Patent Document 1, exhaust-gas communication paths for guiding exhaust gases, respectively, from the exhaust gas ports are joined, together; and by providing the exhaust gas sensor at the joining point, an air-fuel ratio in the multiple cylinders is determined by a small number of the exhaust gas sensors.

PRIOR ART DOCUMENTS

Patent Documents

Patent Document 1: Japanese Unexamined Patent Application Publication No, 2006-17081

SUMMARY OF THE INVENTION

Problems to be Solved by the Invention

However, in order to realize the aforementioned conventional method of determining an air-fuel ratio in the multiple cylinders, the following problem arises: since it is necessary to form an exhaust-gas communication path for each of the exhaust gas ports by pipe-laying or to form an exhaust-gas communication path between a cylinder head and a head flange, the configurations of each of the exhaust-gas communication paths become complex.

An object of the present invention is to provide an exhaust device which has a simple configuration and enables determination of an air-fuel ratio with a small number of exhaust gas sensors, by making an improvement in which exhaust gases from each cylinder are uniformly made to contact with the exhaust gas sensors.

Means for Solving the Problems

In order to achieve the above object, an exhaust device of the present invention includes: an exhaust manifold which is connected to each of exhaust ports of a multicylinder internal combustion engine, and which collects exhaust gases from the each of exhaust ports; an upstream-side cone of a catalyst which is connected to the exhaust manifold and purifies the exhaust gases; an exhaust gas sensor that is provided in the upstream-side cone; an outer shell that is superposed on an outer side of the upstream-side cone; and a sensor chamber that is formed between the upstream-side cone and the outer shell.

Moreover, in the exhaust device of the present invention, the upstream-side cone is provided with a flow outlet through which the sensor chamber is communicated with an inside of the upstream-side cone; an inflow channel is formed between the upstream-side cone and the outer shell, the inflow channel having an opening that opens inside the exhaust manifold so as to communicate with the sensor chamber.

In the exhaust device of the present invention constituted as above, the inflow channel may be formed by concaving the upstream-side cone radially-inward thereof. Moreover, the sensor chamber may be formed such that the outer shell is outwardly convexed. Furthermore, a plurality of pairs of the inflow channel and the opening may be provided. The outer shell may be provided with an attachment hole for the exhaust gas sensor, which communicates with the sensor chamber.

Effects of the Invention

The exhaust device of the present invention has a simple configuration in which the outer shell is superposed on the outer side of the upstream-side cone. Consequently, the exhaust device of the present invention exhibits the following effects: it is possible to uniformly introduce exhaust gases from multiple cylinders into the sensor chamber, and therefore, determine an air-fuel ratio without variations depending on each of the cylinders, even with a small number of the exhaust gas sensors.

BRIEF DESCRIPTION OF THE DRAWINGS

FIGS. 5A-5D are explanatory views showing flows of exhaust gases in a cross section taken along a line A-A in FIG. 1.

EXPLANATION OF REFERENCE NUMERALS

| | |
|---|---|
| 1 exhaust manifold | 2 flange |
| 4 main body | 20 catalyst |
| 22 upstream-side cone | 24 cylindrical portion |
| 26 downstream-side cone | 28 small-diameter part |
| 30 tapered part | 32 large-diameter part |
| 34 outer shell | 36 sensor chamber |
| 38 attachment bore | 39 exhaust gas sensor |
| 40 recess | 42 flow outlet |
| 44, 46 groove | 48, 50 inflow channel |
| 52, 54 opening | 80 exhaust device |
| 100 internal combustion engine | |

MODE FOR CARRYING OUT THE INVENTION hereinafter, an embodiment for carrying out the present invention will be described in detail with reference to the drawings.

Figure 1:
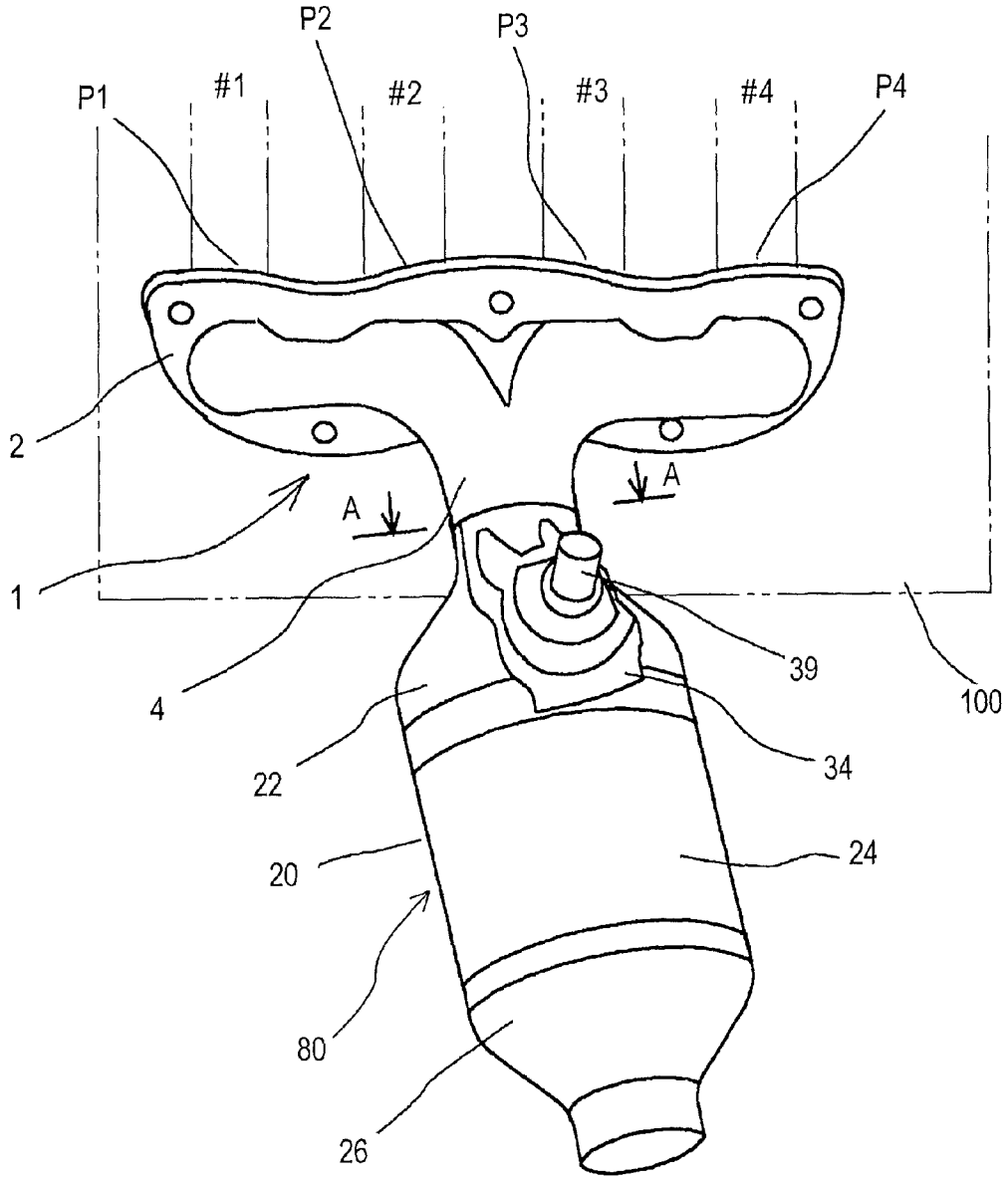
FIG. 1 is a front elevational view of an exhaust device as one embodiment of the present invention.

As shown in FIG. 1, an exhaust device 80 includes an exhaust manifold 1, an upstream-side cone 22, a cylindrical portion 24, a downstream-side cone 26, and an outer shell 34.

The exhaust manifold 1 of the present embodiment is to be used for a four-cylinder internal combustion engine 100. The internal combustion engine 100 includes a first exhaust port P1 to a fourth exhaust port P4 communicating respectively with a first cylinder #1 to a fourth cylinder #4. In the present embodiment, ignition is performed in an order of the first cylinder #1, the third cylinder #3, the fourth cylinder #4, and the second cylinder #2.

Figure 2:
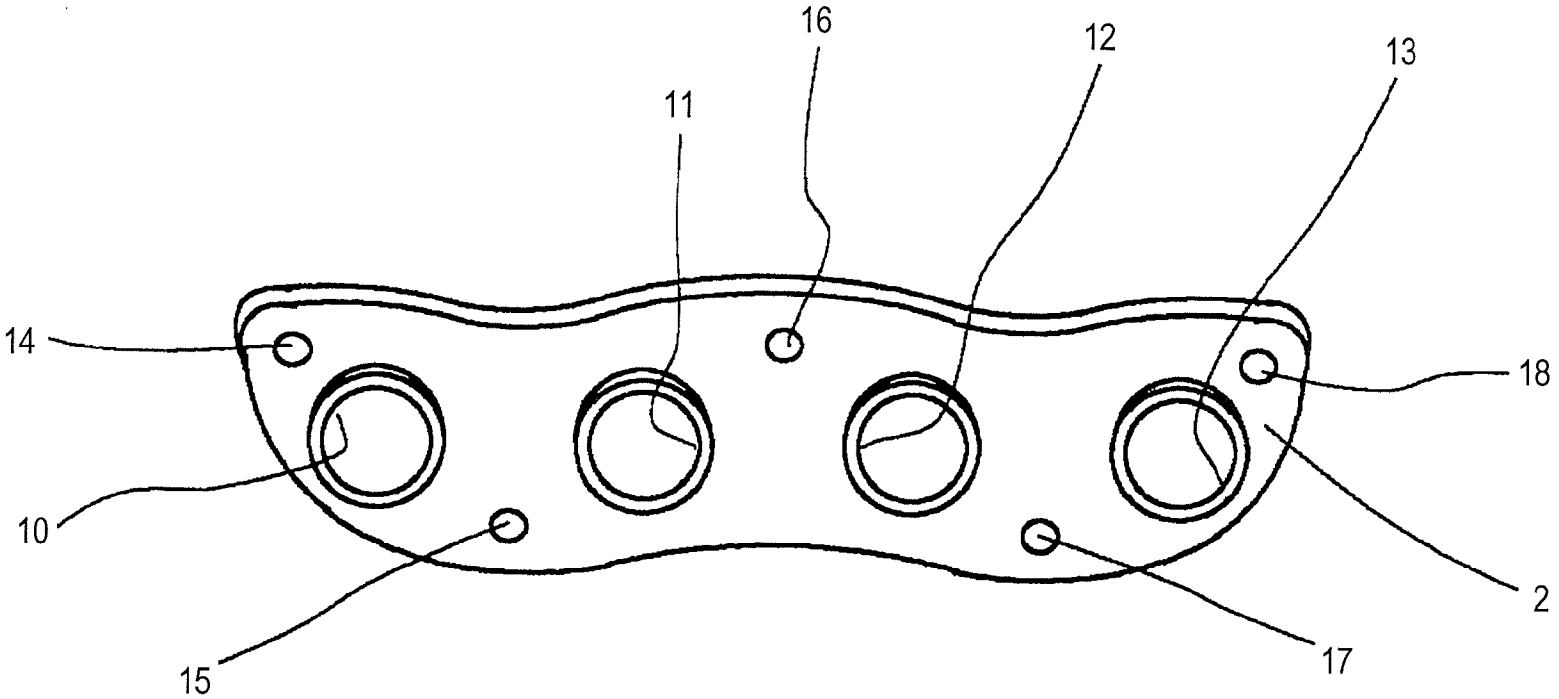
FIG. 2 is a front elevational view of a flange of an exhaust manifold in the embodiment.

The exhaust manifold 1 includes a flange 2 and a main body 4. As shown in FIG. 2, four through holes 10 to 13 corresponding, respectively, to the first exhaust port P1 to the fourth exhaust port P4 are bored in the flange 2. The flange 2 is also provided with a plurality of attachment holes 14 to 18 for attaching the flange 2 to the internal combustion engine 100 with not-shown bolts.

The main body 4 of the exhaust manifold 1 collects exhaust gases from the first exhaust port P1 to the fourth exhaust port P4 and discharges the exhaust gases to a downstream side. A catalyst 20 which purifies exhaust gases is connected to the main body 4. The catalyst 20 is also connected to a downstream-side exhaust pipe which is not shown here. The catalyst 20 includes a catalyst main body (not shown) contained within a hollow container formed by the upstream-side cone 22, the cylindrical portion 24, and the downstream-side cone 26.

The exhaust gases from the first exhaust port P1 to the fourth exhaust port P4, respectively, in the internal combustion engine 100 flow through the through holes 10-13, respectively, to be collected within the exhaust manifold 1. Thereafter, the exhaust gases flow into the upstream-side cone 22 of the catalyst 20. The exhaust gases which have been purified by the catalyst main body are discharged from the downstream-side cone 26 to the downstream-side exhaust pipe.

Figure 3:
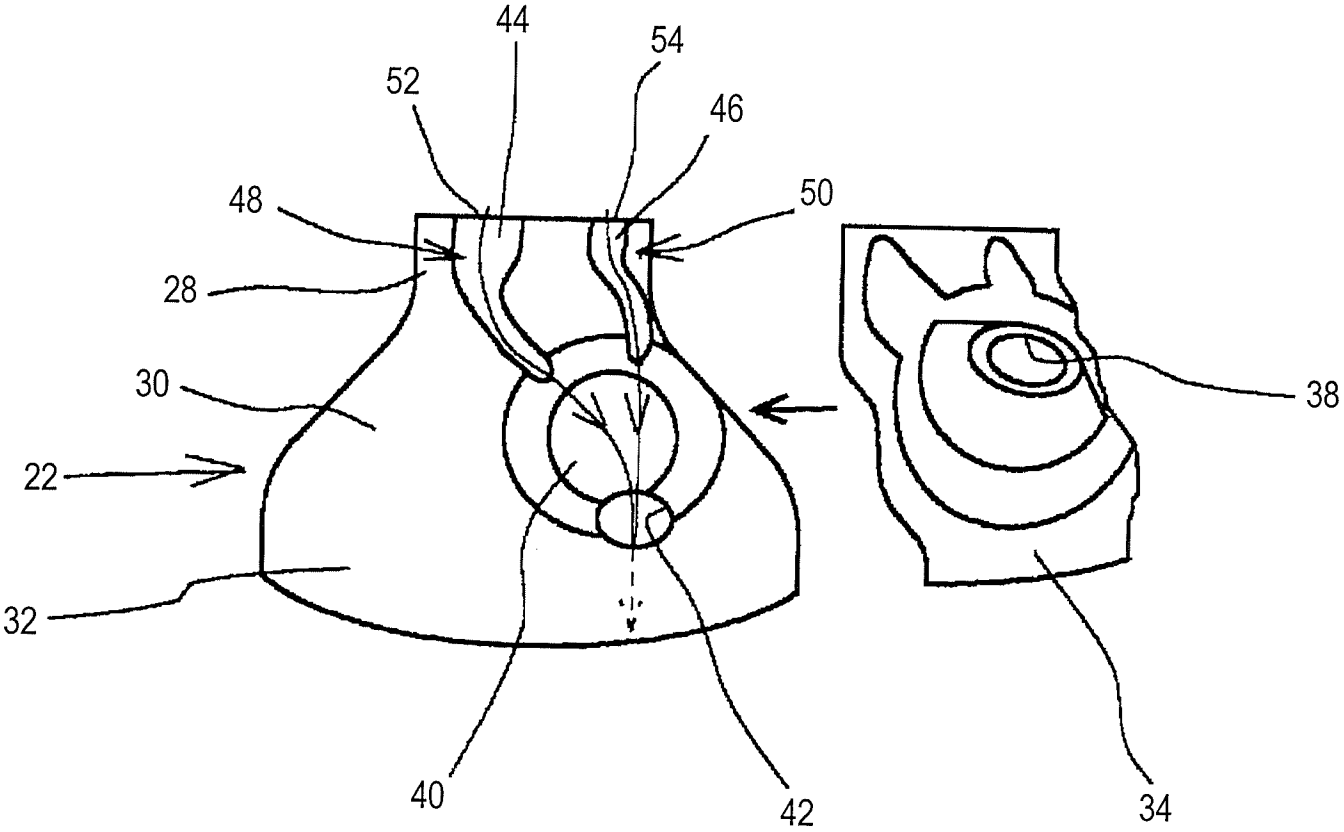
FIG. 3 is an exploded view of an upstream-side cone and an outer shell in the embodiment.
Figure 4:
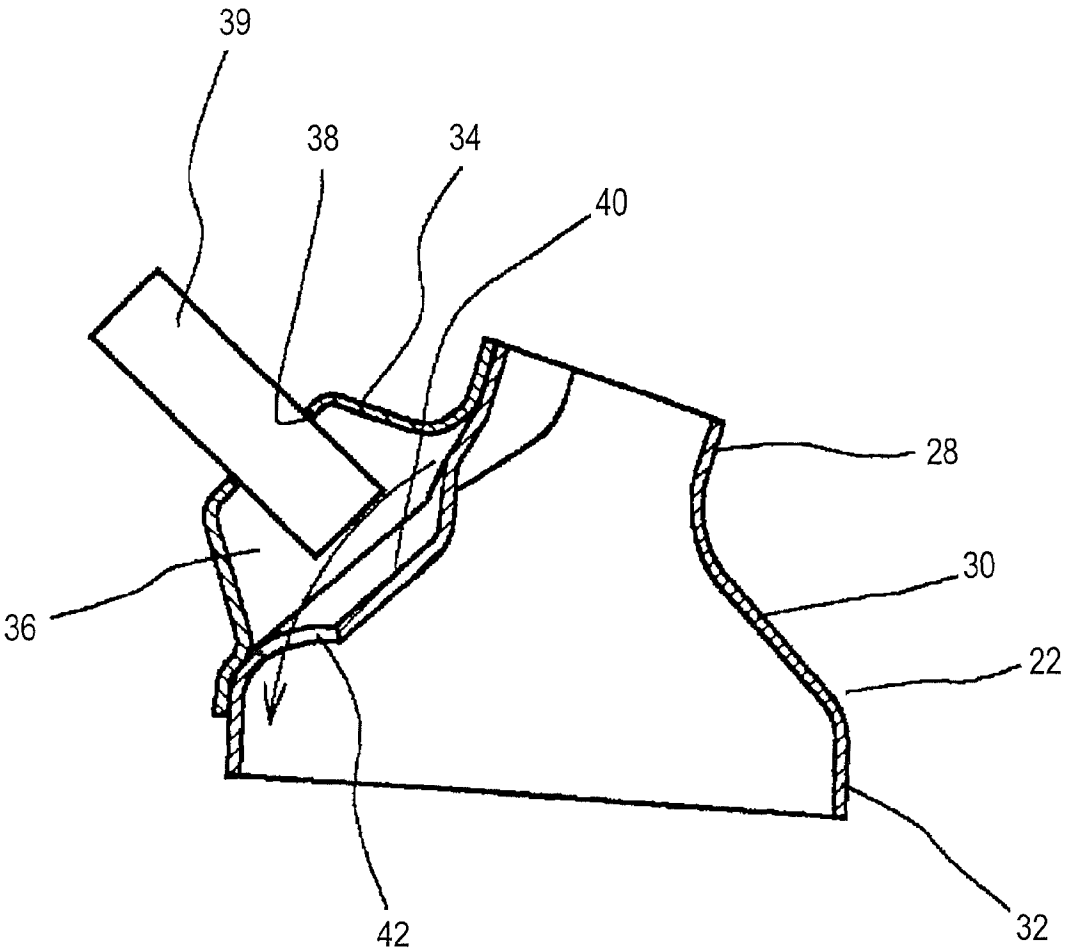
FIG. 4 is a cross-sectional view showing a state in which the outer shell is superposed upon the upstream-side cone in the embodiment.

As shown in FIGS. 3 and 4, the upstream-side cone 22 is provided with a cylindrical small-diameter part 28 to be connected to the main body 4 of the exhaust manifold 1, and a tapered part 30 provided to connect with the small-diameter part 28. The tapered part 30 has a diameter increasing in a tapered manner and is provided to connect with a cylindrical large-diameter part 32. The large-diameter part 32 is connected with the cylindrical portion 24. The upstream-side cone 22 may be formed in an integral manner by press working. Alternatively, the upstream-side cone 22 may be constituted such that a plurality of divided members divided in an axial direction are joined together, thereby forming the upstream-side cone 22 as one component.

Superposed on an outer side of the upstream-side cone 22 is an outer shell 34. The outer shell 34 is convexed radially-outward of the upstream-side cone 22, thereby forming a closed sensor chamber 36 between the upstream-side cone 22 and the outer shell 34.

Moreover, an attachment bore 38, which communicates with the sensor chamber 36, is formed in the outer shell 34. The attachment bore 38 is bored toward substantially a center of the catalyst 20 in an axial direction thereof. An exhaust gas sensor 39 is attached to the attachment bore 38.

Corresponding to the sensor chamber 36, the upstream-side cone 22 is concaved radially-inward thereof, thereby forming a recess 40 in the upstream-side cone 22. Moreover, in the upstream-side cone 22, a flow outlet 42 is formed to communicate the sensor chamber 36 with an inside of the upstream-side cone 22. The flow outlet 42 is formed in the recess 40 on a side of the large-diameter part 32. The flow outlet 42 is bored along the axial direction of the catalyst 20.

Furthermore, in the upstream-side cone 22, two lines of grooves 44 and 46 are formed by concaving the upstream-side cone 22 radially-inward thereof. Each of the grooves 44 and 46 is formed to reach an inside of the recess 40 from an upstream end of the small-diameter part 28. By the grooves 44 and 46 provided between the upstream-side cone 22 and the outer shell 34 as explained above, inflow channels 48 and 50 are formed.

That is to say, the grooves 44 and 46 are formed such that a tip-end detection part of the exhaust gas sensor 39 can be provided on an extended line from the inflow channels 48 and 50; the flow outlet 42 is provided such that exhaust gases, which have flowed into the sensor chamber 36 from the inflow channels 48 and 50, smoothly flow out from the flow outlet 42.

Openings 52 and 54 are formed on the upstream end of the small-diameter part 28. An end of the main body 4 on a side of the small-diameter part 28, is formed to be a cylindrical shape having a diameter substantially the same as a diameter of the small-diameter part 28. Accordingly, when the small-diameter part 28 of the upstream-side cone 22 and, the main body 4 of the exhaust manifold 1 are connected to each other, the openings 52 and 54 as respective inlets into the inflow channels 48 and 50 are located within the exhaust manifold 1.

As shown in FIGS. 5A-5D, when exhaust gases from each of the first exhaust port P1 to the fourth exhaust port P4 flow into the inside of the upstream-side cone 22 of the catalyst 20 from the exhaust manifold 1, the exhaust gases from each of the first cylinder #1 to the fourth cylinder #4 have a different flow-rate distribution at the upstream end of the small-diameter part 28.

The exhaust gases from the first cylinder #1 flow mainly in a position located along an inner wall of the main body 4 on the right side in FIG. 5A, and then flow into the small-diameter part 28. Thus, as shown in FIG. 5A, a flow rate of the exhaust gases flowing in a central area of the upstream end of the small-diameter part 28 is slow, while the flow rate of the exhaust gases flowing along the inner wall on the right side in FIG. 5A is fast. The exhaust gases from the second cylinder #2 flow mainly in a position located along the inner wall of the main body 4 from the bottom side to the lower right side in FIG. 5B, and then flow into the small-diameter part 28. Thus, as shown in FIG. 5B, a flow rate of the exhaust gases flowing in the central area of the upstream end of the small-diameter part 28 is slow, while the flow rate of the exhaust gases flowing in an area from the bottom side to the lower right side in FIG. 5B is fast.

The exhaust gases from the third cylinder #3 flow mainly in a position located along the inner wall of the main body 4 on the lower side in FIG. 5C, and then flow into the small-diameter part 28. Thus, as shown in FIG. 5C, a flow rate of the exhaust gases flowing in the central area of the upstream end of the small-diameter part 28 is slow, while the flow rate of the exhaust gases flowing at the lower side in FIG. 5C is fast. The exhaust gases from the fourth cylinder #4 flow mainly in a position close to the inner wall of the main body 4 on the lower left side in FIG. 5D, and then flow into the small-diameter part 28. Thus, as shown in FIG. 5D, a flow rate of the exhaust gases in the central area of the upstream end of the small-diameter part 28 is slow, while the flow rate of the exhaust gases flowing at the lower left side in FIG. 5D is fast.

As described above, each of the exhaust gases from the first cylinder #1 to the fourth cylinder #4 has a fast flow rate at a different position within the small-diameter part 28 of the upstream-side cone 22 and within the main body 4 of the exhaust manifold 1. That is to say, the flow rate of the exhaust gases is slow around the central area of the main body 4 and of the small-diameter part 28, and is fast at positions along the inner wall.

As above, depending on positions of the openings 52 and 54, respectively, of the inflow channels 48 and 50, a flow volume and the flow rate of the exhaust gases to be introduced into the sensor chamber 36 are different. Since the flow volume and the flow rate of the exhaust gases are different as explained above, an air-fuel ratio which is detected based on a detection result of the exhaust gas sensor 39 for the exhaust gases from each of the first cylinder #1 to the fourth cylinder #4 involves detection errors such as variations.

In the present embodiment, the openings 52 and 54 of the inflow channels 48 and 50 are provided at common positions to the first cylinder #1 to the fourth cylinder #4, as positions inside the upstream end of the small-diameter part 28 where the exhaust gases from the first cylinder #1 to the fourth cylinder #4 mainly pass through and as positions inside the upstream end of the small-diameter part 28 where the flow rate of the exhaust gases is fast. As shown in FIGS. 5A to 5D, the one opening 52 is provided on the lower left side in these figures, while the other opening 54 is provided on the lower right side in these figures. With respect to the positions at which the openings 52 and 54 are provided, the position of at least one of the openings 52 and 54 corresponds to the position where the flow rate of the exhaust gases from the first cylinder #1 to the fourth cylinder #4 is fast.

In the present embodiment, two pairs of the inflow channel 48 and the opening 52, and the inflow channel 50 and the opening 54 are provided. However, pairs of the inflow channel and the opening in the present invention are not limited to the above pairs; one pair of a large opening and an inflow channel may be provided at a common location as a position at which the exhaust gases mainly flow and as a position at which the flow rate of the exhaust gases is fast. Alternatively, each of four pairs of openings and inflow channels may be provided at a position where the exhaust gases from each of the first cylinder #1 to the fourth cylinder #4 mainly flow and a position where the flow rate of the exhaust gases is fast. These positions at which the openings 52 and 54 are to be provided should be determined by an experiment, etc., depending on a shape, etc. of the exhaust manifold 1.

Next, explanation will be given with respect to the exhaust gases flowing through the aforementioned exhaust device 80 according to the present embodiment.

In accordance with a rotation of the internal combustion engine 100, the exhaust gases from each of the first cylinder #1 to the fourth cylinder #4 flow into an inside of the exhaust manifold 1. The exhaust gases flow through the inside of the exhaust manifold 1 and flow into the catalyst 20 from the main body 4 of the exhaust manifold 1. The exhaust gases which have flowed into the catalyst 20 from the upstream-side cone 22 are purified within the catalyst 20, and then discharged to the downstream-side exhaust pipe from the downstream-side cone 26.

Part of the exhaust gases flowing into the upstream-side cone 22 flows into the inflow channels 48 and 50, respectively, via the openings 52 and 54, and flows into the sensor chamber 36 via the inflow channels 48 and 50. The exhaust gases which have flowed into the sensor chamber 36 are returned again to the large-diameter part 32 of the upstream-side cone 22 via the flow outlet 42. The exhaust gas sensor 39 determines an air-fuel ratio based on the exhaust gases which flowed into the sensor chamber 36.

Here, with respect to the exhaust gases which have flowed into the sensor chamber 36 through the inflow channels 48 and 50 via the openings 52 and 54, for example, in the case of the exhaust gases from the first cylinder #1, the flow rate of such exhaust gases is fast at the right side in the upstream end of the small-diameter part 28 (the right side in FIG. 5A), as shown in FIG. 5A. In the case of the exhaust gases from the second cylinder #2, as shown in FIG. 5B, such exhaust gases, which have a fast flow rate and flow from the lower side (the lower side in FIG. 5B) to the lower at side (the lower right side in FIG. 5B) in the upstream end of the small-diameter part 28, flow into the sensor chamber 36.

In the case of the exhaust gases from the third cylinder #3, as shown in FIG. 5C, such exhaust gases, which have a fast flow rate and flow at the lower side (the lower side in FIG. 5C) in the upstream end of the small-diameter part 28, flow into the sensor chamber 36. In the case of the exhaust gases from the fourth cylinder #4, as shown in FIG. 5D, such exhaust gases, which have a fast flow rate and flow at the lower left side (the lower left side in FIG. 5D) in the upstream end of the small-diameter part 28, flow into the sensor chamber 36.

As above, by a simple configuration in which the outer shell 34 is superposed on the upstream-side cone 22, it is possible to flow the exhaust gases, which have a fast flow rate, from the first cylinder #1 to the fourth cylinder #4 into the sensor chamber 36, and to introduce uniformly the exhaust gases from each cylinder of the first cylinder #1 to the fourth cylinder #4, into the sensor chamber 36. Thus, it is possible to suppress occurrence of detection errors, such as variations, caused by differences in a flow volume of the exhaust gases and a flow rate of the exhaust gases in determination of an air-fuel, ratio in each of the first cylinder #1 to the fourth cylinder #4.

As above, the present invention should not at all be limited to the above described embodiment, but may be practiced in various forms without departing from the gist of the present invention.

What is claimed is:

1. An exhaust device comprising:

an exhaust manifold which is connected to each of exhaust ports of a multicylinder internal combustion engine and which collects exhaust gases from the each of exhaust ports;

an-upstream-side cone of a catalyst which is connected to the exhaust manifold and purifies the exhaust gases;

an exhaust gas sensor that is provided in the upstream-side cone;

an outer shell that is superposed on an outer side of the upstream-side cone; and a sensor chamber that is formed between the upstream-side cone and the outer shell, wherein the upstream-side cone is provided with a flow outlet through which the sensor chamber is communicated with an inside of the upstream-side cone, and wherein an inflow channel is formed between the upstream-side cone and the outer shell, the inflow channel having an opening that opens inside the exhaust manifold so as to communicate with the sensor chamber.

2. The exhaust device according to claim 1, wherein the inflow channel is formed by concaving the upstream-side cone radially-inward thereof.

3. The exhaust device according to claim 2, wherein the sensor chamber is formed such that the outer shell is outwardly convexed.

4. The exhaust device according to claim 3, wherein a plurality of pairs of the inflow channel and the opening are provided.

5. The exhaust device according to claim 4, wherein the outer shell is provided with an attachment hole for the exhaust gas sensor, the attachment hole communicating with the sensor chamber.

6. The exhaust device according to claim 3, wherein the outer shell is provided with an attachment hole for the exhaust gas sensor, the attachment hole communicating with the sensor chamber.

7. The exhaust device according to claim 2, wherein a plurality of pairs of the inflow channel and the opening are provided.

8. The exhaust device according to claim 7, wherein the outer shell is provided with an attachment hole for the exhaust gas sensor, the attachment hole communicating with the sensor chamber.

9. The exhaust device according to claim 2, wherein the outer shell is provided with an attachment hole for the exhaust gas sensor, the attachment hole communicating with the sensor chamber.

10. The exhaust device according to claim 1, wherein the sensor chamber is formed such that the outer shell is outwardly convexed.

11. The exhaust device according to claim 10, wherein a plurality of pairs of the inflow channel and the opening are provided.

12. The exhaust device according to claim 11, wherein the outer shell is provided with an attachment hole for the exhaust gas sensor, the attachment hole communicating with the sensor chamber.

13. The exhaust device according to claim 10, wherein the outer shell is provided with an attachment hole for the exhaust gas sensor, the attachment hole communicating with the sensor chamber.

14. The exhaust device according to claim 1, wherein a plurality of pairs of the inflow channel and the opening are provided.

15. The exhaust device according to claim 14, wherein the outer shell is provided with an attachment hole for the exhaust gas sensor, the attachment hole communicating with the sensor chamber.

16. The exhaust device according to claim 1, wherein the outer shell is provided with an attachment hole for the exhaust gas sensor, the attachment hole communicating with the sensor chamber.

* * * * *